US007284298B2

(12) United States Patent
Stein

(10) Patent No.: US 7,284,298 B2
(45) Date of Patent: Oct. 23, 2007

(54) EXHAUST FILTER ARRANGEMENT FOR VACUUM CLEANER HOUSING

(75) Inventor: Thomas Stein, Velbert (DE)

(73) Assignee: Stein & Co. GmbH, Velbert (DE)

( * ) Notice: Subject to any disclaimer, the term of this patent is extended or adjusted under 35 U.S.C. 154(b) by 707 days.

(21) Appl. No.: 10/773,666

(22) Filed: Feb. 6, 2004

(65) Prior Publication Data

US 2004/0158952 A1 Aug. 19, 2004

(30) Foreign Application Priority Data

Feb. 7, 2003 (DE) ..... 103 05 217

(51) Int. Cl.
*A47L 9/12* (2006.01)

(52) U.S. Cl. ..... 15/347; 15/327.2

(58) Field of Classification Search ..... 15/325, 15/326, 327.1, 327.2, 327.3, 327.4, 327.5, 15/327.6, 327.7, 347, 350–353

See application file for complete search history.

(56) References Cited

U.S. PATENT DOCUMENTS

| | | | | |
|---|---|---|---|---|
| 3,516,110 | A * | 6/1970 | Nilsson | 15/325 |
| 3,883,922 | A * | 5/1975 | Fleischhauer | 15/327.1 |
| 4,437,204 | A * | 3/1984 | Guhne | 15/325 |
| 4,831,682 | A * | 5/1989 | White | 15/246.2 |
| 5,687,450 | A * | 11/1997 | Stein et al. | 15/325 |
| 2004/0003480 | A1 * | 1/2004 | Kovacs | 15/246.2 |

FOREIGN PATENT DOCUMENTS

EP 0706774 4/1996

* cited by examiner

*Primary Examiner*—Theresa T. Snider
(74) *Attorney, Agent, or Firm*—W. F. Fasse; W. G. Fasse

(57) ABSTRACT

An exhaust filter unit is arranged outwardly surrounding at least a major portion of a housing of a vacuum cleaner. The dirt-laden incoming airflow is filtered through a primary filter, then blown by a suction motor unit into an annular exhaust air space between the vacuum cleaner housing and the exhaust filter unit. Thereby, the filtered air is exhausted in a diffused manner through the large surface area of the exhaust filter unit. Preferably, the exhaust filter unit has a cylindrical tubular configuration that completely externally surrounds a cylindrical portion of the vacuum cleaner housing.

14 Claims, 1 Drawing Sheet

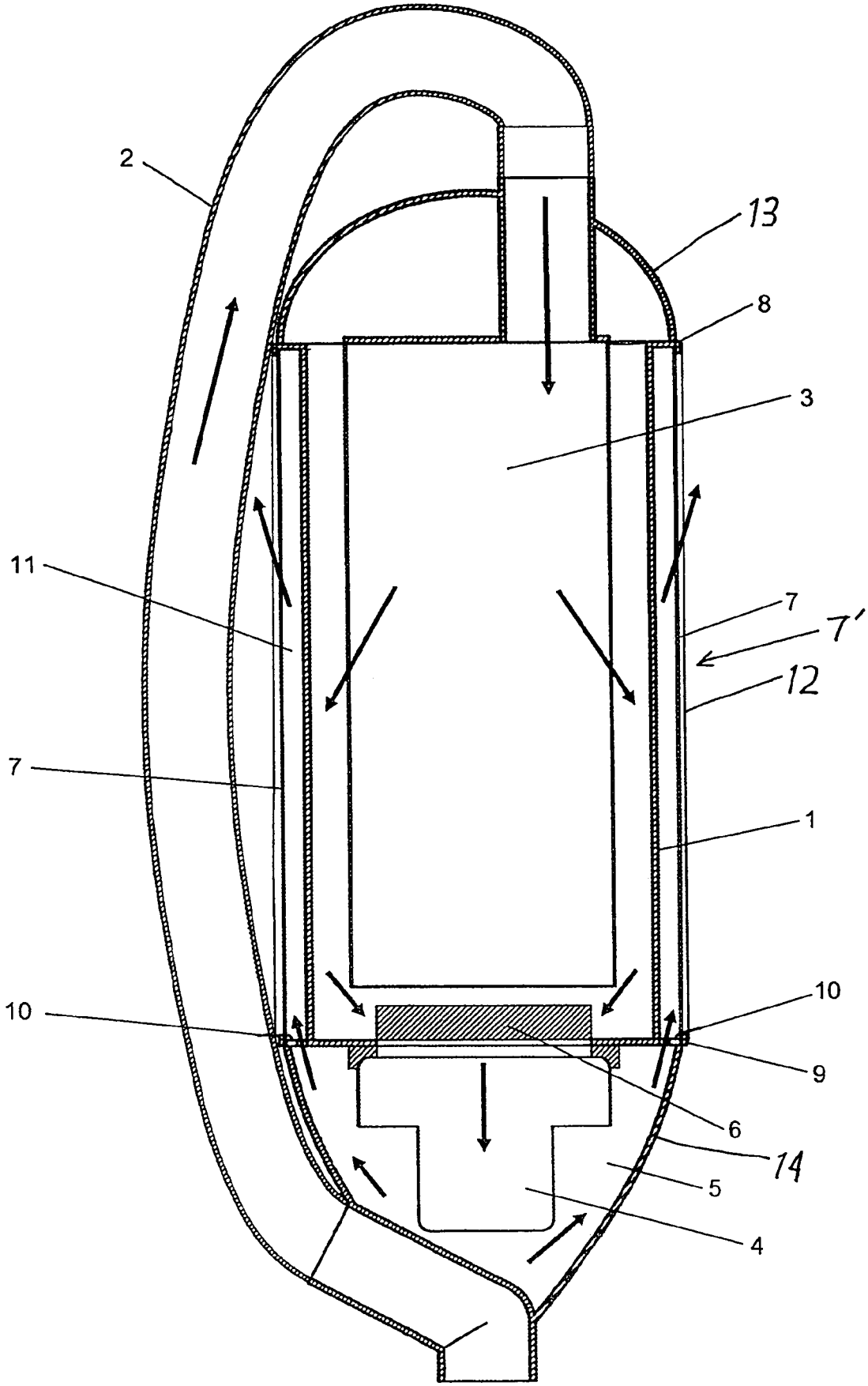
2
13
8
3
11
7
7'
12
7
1
10
10
9
6
14
5
4

EXHAUST FILTER ARRANGEMENT FOR VACUUM CLEANER HOUSING

PRIORITY CLAIM

This application is based on and claims the priority under 35 U.S.C. §119 of German Patent Application 103 05 217.8 filed on Feb. 7, 2003, the entire disclosure of which is incorporated herein by reference.

FIELD OF THE INVENTION

The invention relates to the arrangement of an exhaust or outlet filter for a floor cleaning device such as a vacuum cleaner, which further has a primary dust and dirt separating unit or dirt collector arranged upstream of a suction motor unit, and the exhaust filter arranged downstream of the motor unit, so that the filtered airflow is ultimately exhausted to the surrounding atmosphere through the exhaust filter.

BACKGROUND INFORMATION

Conventional vacuum cleaners typically have a primary dust and dirt separating unit or dirt collector, such as a primary filter bag, primary filter element, or other dirt separation device such as a cyclonic separation device, into which the dirt-laden incoming vacuum airflow is directed from the vacuum hose, for example. After most of the dust and dirt are separated from the airflow in the primary dirt collector, the primary filtered airflow then optionally passes through a motor protection filter to the suction motor unit including the vacuum blower or fan and the drive motor. From there, the airflow is blown by the motor unit into an outlet or exhaust channel that leads to a plurality of adjacently arranged outlet slots or exhaust openings in the vacuum cleaner housing, through which the airflow is exhausted, i.e. blown out from the vacuum cleaner to the surrounding atmosphere.

In typical conventional vacuum cleaners, the exhausted airflow is emitted from the exhaust openings of the housing with a substantially high flow velocity. Also, the exhaust airflow is often emitted in a relatively concentrated jet stream. Due to this relatively strong localized concentration of the exhaust airflow, and the high flow velocities thereof, flow-generated noise is emitted, which represents a substantial portion of the total noise emission of the operating vacuum cleaner. Furthermore, a portion of the noise emission of the motor unit is also transmitted to and emitted from the exhaust openings of the housing. In addition to the emitted noise, the exhaust airflow in the manner of a concentrated jet has other undesirable influences, such as the strong blowing effect that is very noticeable by the person using the vacuum cleaner.

For flowtechnical reasons, e.g. to increase the operating efficiency of the vacuum cleaner by minimizing the air flow resistance, vacuum cleaner designs strive to provide the largest possible cross-sectional area of the exhaust channel and especially the exhaust outlet openings in the housing of the vacuum cleaner, in order thereby to achieve a small exhaust air flow resistance. However, contrary to these requirements, it is also desired to reduce the noise emissions as discussed above, which could be achieved by providing a relatively large air flow resistance. Thus, these two requirements, of efficient operation through a reduced flow resistance on the one hand, and reduced noise emissions through an increased flow resistance on the other hand, are directly opposed to each other.

European Patent Publication EP 0,706,774 B discloses an attempt to improve on the above mentioned balancing between the two opposite goals. Particularly, this European Patent Publication suggests to increase the outlet cross-sectional area through corresponding covered openings in the form of slots in the side walls of the housing of the vacuum cleaner in the manner of a protective shroud.

SUMMARY OF THE INVENTION

In view of the above, it is an object of the invention to provide a structurally simple exhaust arrangement for a vacuum cleaner housing, whereby the exhaust or outlet flow area can be further increased and a relatively low exhaust flow velocity can be achieved, while additionally providing improved noise damping, especially in comparison to the prior art. The invention further aims to avoid or overcome the disadvantages of the prior art, and to achieve additional advantages, as apparent from the present specification. The attainment of these objects is, however, not a required limitation of the present invention.

The above objects have been achieved according to the invention in an exhaust filter arrangement of a vacuum cleaner. The vacuum cleaner includes a primary dust and dirt separating unit or primary dirt collector connected to an inlet suction channel such as a vacuum hose and arranged upstream of a suction motor unit. The primary dirt collector may be a filter bag, for example. From there, the primary filtered air is sucked through the motor unit, which includes a vacuum blower or fan and a drive motor, and then blown out via the exhaust arrangement. According to the invention, the exhaust arrangement comprises an exhaust filter unit including an exhaust filter material that outwardly covers and extends over at least a large surface area of the vacuum cleaner housing. This large surface area of the vacuum cleaner housing is especially the housing of the primary dirt collector and preferably has a cylindrical shape. The exhaust filter unit outwardly covers and extends over at least one third, or preferably at least one half, or even more preferably at least two thirds, or even the entirety of the surface area of the housing of the primary dirt collector. Preferably, the filter material of the exhaust filter unit has a cylindrical or generally tubular shape and either completely or at least partially surrounds, encloses, and envelops the pertinent portion of the vacuum cleaner housing. In this arrangement, an annular exhaust air space is formed between the vacuum cleaner housing and the outwardly located filter material of the exhaust filter unit. The primary filtered airflow is blown by the motor unit from the motor chamber through exhaust passages into this exhaust air space, from which the exhaust air then flows outwardly in a diffused non-concentrated and low-speed manner through the relatively large cross-sectional flow area of the filter material of the exhaust filter unit.

In this context, the invention uses a relatively simple technical measure to achieve a large exhaust flow surface area, so that only low flow velocities will arise in the exhaust flow area. Thereby, the total exhaust flow volume is distributed over a large surface area, e.g. a large portion of the total outer surface area of the vacuum cleaner housing, so that the exhaust flow is quite diffused and does not form a noticeable jet of exhaust air. Also, the development of flow-generated noise is thereby very low. The provision of the exhaust filter material outwardly around and substantially enclosing or enveloping the vacuum cleaner housing additionally provides noise damping to reduce the total noise emission including the emission of motor-generated noise.

Furthermore, the low flow velocity in the area of the exhaust filter additionally provides the advantage that a high degree of separation and filter-collection of suspended particles in the exhaust airflow can be achieved. Thus, a high degree of filtering quality can be efficiently achieved, to separate even very small, e.g. micron range, dust and dirt particles or other suspended contaminants from the exhaust airflow before it is emitted to the surrounding atmosphere. Particularly it is preferred that the exhaust filter material is of a microfilter quality. The exhaust filter can also comprise a filter element designated as a HEPA (High Efficiency Particulate Arresting) filter. Furthermore, due to the relatively large filter volume and filter surface area, a high operating life of the filter is achieved despite the high degree of particle filtering and containment.

Another advantageous effect of the inventive exhaust filter arrangement is an external visual effect. Namely, the externally, visibly arranged filter unit can provide a strong advantageous influence on the overall shape, configuration, and visual appearance of the vacuum cleaner arrangement. For example, different aesthetic forms or appearances can be achieved, simply by providing different exhaust filter units, on identical basic vacuum cleaner devices. For example, the predominant color or visual appearance such as a pattern or the like of the visible exterior of the vacuum cleaner can easily be changed as desired simply by providing a selected different exhaust filter unit having a different color or different pattern or the like. Preferably the majority or substantially all of the exhaust filter (except for portions covered by filter supporting or securing elements) is externally visible.

In a relatively simple embodiment for mounting the exhaust filter unit, the tubular filter material is secured at its two open ends via respective securing elements in a releasable or detachable manner at adjoining portions of the housing, to which the filter material is also sealed in an airtight manner. These securing elements can be fixed or movable or flexible securing rims or flanges into which the open edges of the filter material are seated in a sealed manner. Alternatively, an end cap of the preferably cylindrical vacuum cleaner housing can be removable or openable (e.g. hinged), so as to allow the removal and replacement of both the internal primary filter bag as well as the external exhaust filter unit in an axial direction from this opened end of the vacuum cleaner housing. Preferably, the removable end cap is the inlet end cap of the housing, opposite the motor housing at the end in which the motor unit is arranged. Furthermore, exhaust flow passages are provided to pass into the annular exhaust air space from the motor chamber formed in the motor housing.

In view of the externally visible and generally exposed arrangement of the exhaust filter unit, it is preferred that the filter unit includes measures to protect the exhaust filter element from damage due to any external impact, for example by tools of the vacuum cleaner itself, or by furnishings, doors, door frames, or the like as may arise during use of the vacuum cleaner. In this regard, the vacuum cleaner or the exhaust filter unit preferably additionally includes an elastic or resilient support body, e.g. in the form of flexible ribs, a grid, a cage, or elastic bands. This support body can be arranged inwardly or externally relative to the exhaust filter material so as to support and protect the exhaust filter material. Alternatively, the externally arranged filter material can be formed by an air permeable elastic support body.

BRIEF DESCRIPTION OF THE DRAWINGS

In order that the invention may be clearly understood, it will now be described with reference to the accompanying single drawing FIGURE, which schematically shows an example embodiment of the invention in section.

DETAILED DESCRIPTION OF A PREFERRED EXAMPLE EMBODIMENT AND OF THE BEST MODE OF THE INVENTION

As shown in the single drawing FIGURE, the inventive exhaust filter arrangement can be used in connection with a portable vacuum cleaner, such as a handheld vacuum cleaner. The illustrated exemplary vacuum cleaner includes a vacuum cleaner housing that includes several housing portions, namely a main housing portion that especially forms a primary dirt collector housing 1, an inlet end cap 13 as another portion of the overall vacuum cleaner housing, and a motor housing 14 that forms another portion of the overall vacuum cleaner housing.

The main housing portion, i.e. the housing 1 preferably has a cylindrical shape, but may alternatively have a half-cylindrical shape or some other configuration. At one end of the housing 1, the inlet end cap 13 is secured thereto, either fixedly or releasably. A suction channel such as a vacuum hose 2 is connected to the inlet end cap 13 to thereby communicate into the housing 1. A primary dust and dirt separator, such as a primary filter preferably embodied as a primary filter bag 3, is arranged in the housing 1 so that the vacuum hose 2 communicates the dust-laden inlet airflow into the inside of the filter bag 3.

At the end of the housing 1 opposite the inlet end cap 13, the motor housing 14 encloses a suction motor unit 4 that is mounted at this end of the housing 1. The motor unit 4 includes any conventionally known vacuum blower or fan connected to a drive motor. Also, a motor protective filter 6 may be arranged upstream of the motor unit 4, i.e. in the flow direction between the filter bag 3 and the motor unit 4. Thus, as shown, the motor unit 4 is located below the filter bag 3. A motor chamber 5 is formed around and below the motor unit 4, within the motor housing 14.

As indicated by the air flow arrows, the dust laden inlet air, arriving from a suction device such as a floor cleaning tool or a handheld vacuum brush, flows through the vacuum hose 2 via the inlet end cap 13 into the primary filter bag 3, in which most of the dirt and dust is separated and collected. The primary filtered airflow then flows outwardly through the wall of the filter bag 3 and downwardly between the filter bag 3 and the housing 1, to then pass through the motor protective filter 6 and be blown through the motor unit 4 into the motor chamber 5. From there, the exhaust airflow must be exhausted outwardly from the vacuum cleaner.

The above described components and arrangements of the vacuum cleaner embodiment are merely exemplary, and could alternatively be provided, arranged and configured according to any conventionally known vacuum cleaner embodiments. The special features of the invention will be discussed next in connection with this example embodiment of the vacuum cleaner.

In this regard, the invention provides an exhaust filter unit 7' including a tubular filter material 7 that surrounds or envelops the cylindrical main housing 1. An annular exhaust air space 11 is formed around the housing 1, between the housing 1 and the exhaust filter unit 7'. Flow passages 10 pass substantially annularly from the motor chamber 5 into the annular exhaust air space 11, so that the filtered airflow is readily blown by the motor unit 4 via the motor chamber 5 and the passages 10 into the annular exhaust air space 11, and from there in a diffused and distributed manner outwardly through the filter material 7 of the exhaust filter unit 7'.

The term "annular" herein does not require a complete circular cylindrical annular configuration. For example, the annular exhaust air space 11 may extend around only a portion of a circle, such as a half-circular shell. Also, the configuration of the housing 1 and the exhaust filter unit 7' does not need to be circular in cross-section, but could instead be partial-circular such as half-circular, or some other shape such as square or oval or a complex compound shape in cross-section. Thus, the term "annular" simply refers to the relatively narrow shell space 11 formed between the exhaust filter unit 7' and the housing 1. Preferably, however, the housing 1, the exhaust filter unit 7', and the annular exhaust air space 11 all have a complete circular cylindrical configuration. Also preferably, the primary dirt collector 3, the main housing portion 1, and the exhaust filter unit 7' are all arranged coaxially relative to each other about a common central axis.

The exhaust filter unit 7', or particularly the filter material 7 thereof, is secured via mounting or securing elements 8 and 9 at opposite axial ends of the housing 1 and thereby sealed relative to the housing 1. Namely, in this manner, the annular exhaust air space 11 is sealed and separated from the outside surrounding environment. These mounting or securing elements 8 and 9 may be fixed or movable rims or flanges provided at the ends of the cylindrical housing 1. Alternatively, the inlet end cap 13 may be removable or openable from the cylindrical housing 1, e.g. by releasing one or more latches or catches or the like. In that manner, the axial end of the cylindrical housing 1 is made entirely open and accessible, for the primary filter bag 3 as well as the exhaust filter material 7 to be removed and replaced with new filter elements as needed.

To support and protect the exhaust filter material 7, the exhaust filter unit 7 further preferably includes a somewhat flexible or resilient support body 12, which may comprise a cage, a grid, ribs, or elastic bands, which are arranged inwardly or outwardly with respect to the filter material 7, for supporting and protecting the filter material 7 against impacts and the like.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In a vacuum cleaner including a housing, a primary dirt collector arranged in said housing, a suction motor unit arranged in said housing, an inlet suction channel communicating through said primary dirt collector to an inlet of said suction motor unit, and an exhaust outlet passage communicating from an outlet of said suction motor unit out of said housing to an environment outside of said vacuum cleaner, an improvement comprising an exhaust filter arrangement that is interposed in said exhaust outlet passage and that comprises a tubular exhaust filter material arranged to completely or partially envelop at least a first portion of said housing, wherein an annular exhaust air space is formed as a portion of said exhaust outlet passage between said first portion of said housing and said tubular exhaust filter material.

2. The improvement in the vacuum cleaner according to claim 1, wherein said primary dirt collector is a primary filter bag.

3. The improvement in the vacuum cleaner according to claim 1, further comprising a motor protective filter interposed between said primary dirt collector and said suction motor unit.

4. The improvement in the vacuum cleaner according to claim 1, further comprising first and second securing elements that respectively removably secure and seal opposite axial ends of said tubular exhaust filter material onto said housing, and wherein said housing further includes a motor housing portion in which said suction motor unit is arranged, and said exhaust outlet passage further includes a motor chamber enclosed in said motor housing portion and plural through-flow openings passing from said motor chamber to said annular exhaust air space.

5. The improvement in the vacuum cleaner according to claim 1, wherein said exhaust filter material has a micron particle size filtering quality.

6. The improvement in the vacuum cleaner according to claim 1, wherein said exhaust filter arrangement further comprises an elastic filter support body that supports the exhaust filter material which is externally arranged.

7. The improvement in the vacuum cleaner according to claim 1, wherein said exhaust filter material is externally arranged and comprises and is formed by an air-permeable elastic self-supporting body.

8. A vacuum cleaner comprising:

a housing including a main housing portion and two end housing portions respectively arranged at opposite ends of said main housing portion;

a primary dirt collector arranged inside said main housing portion;

a suction motor unit that is arranged in said housing, and that has a motor unit inlet and a motor unit outlet;

an inlet suction channel communicating through said primary dirt collector to said motor unit inlet;

an exhaust filter arrangement arranged outwardly relative to and externally covering at least a part of said main housing portion while forming an annular exhaust air space between said main housing portion and said exhaust filter arrangement, wherein said annular exhaust air space communicates outwardly through said exhaust filter arrangement to an environment outside of said vacuum cleaner; and an exhaust outlet passage communicating from said motor unit outlet to said annular exhaust air space.

9. The vacuum cleaner according to claim 8, wherein said primary dirt collector, said main housing portion, and said exhaust filter arrangement are all arranged coaxially relative to each other about a common central axis.

10. The vacuum cleaner according to claim 9, wherein said main housing portion and said exhaust filter arrangement each respectively have a hollow cylindrical shape, and said exhaust filter arrangement extends entirely around a circumference of said main housing portion.

11. The vacuum cleaner according to claim 8, wherein said main housing portion and said exhaust filter arrangement each respectively have a hollow cylindrical shape, and said exhaust filter arrangement extends entirely around a circumference of said main housing portion.

12. The vacuum cleaner according to claim 8, wherein said exhaust filter arrangement has a shape of a circular arc segment of an annular partial-cylindrical shell, and extends around a part of an outer circumferential perimeter of said main housing portion.

13. The vacuum cleaner according to claim 8, wherein said exhaust filter arrangement has a tubular shape and extends around an entire outer circumferential perimeter of said main housing portion.

14. The vacuum cleaner according to claim 8, wherein said exhaust filter arrangement is externally exposed and externally visible outside of said housing.

* * * * *